US010212996B2

(12) United States Patent
Stewart-Stand et al.

(10) Patent No.: US 10,212,996 B2
(45) Date of Patent: Feb. 26, 2019

(54) ASYMMETRICAL UMBRELLA

(71) Applicants: Theo Andreas Stewart-Stand, Brooklyn, NY (US); Neal J. McLaughlin, Chappaqua, NY (US)

(72) Inventors: Theo Andreas Stewart-Stand, Brooklyn, NY (US); Neal J. McLaughlin, Chappaqua, NY (US)

( * ) Notice: Subject to any disclaimer, the term of this patent is extended or adjusted under 35 U.S.C. 154(b) by 222 days.

(21) Appl. No.: 15/015,078

(22) Filed: Feb. 3, 2016

(65) Prior Publication Data

US 2016/0227892 A1 Aug. 11, 2016

Related U.S. Application Data

(60) Provisional application No. 62/125,994, filed on Feb. 5, 2015.

(51) Int. Cl.

| | |
|---|---|
| ***A45B 23/00*** | (2006.01) |
| ***A45B 25/18*** | (2006.01) |
| ***A45B 11/00*** | (2006.01) |
| ***A45B 19/00*** | (2006.01) |
| *A45B 15/00* | (2006.01) |

(52) U.S. Cl.

CPC ..... *A45B 23/00* (2013.01); *A45B 25/18* (2013.01); *A45B 15/00* (2013.01); *A45B 19/00* (2013.01); *A45B 2011/005* (2013.01)

(58) Field of Classification Search

CPC ... A45B 11/00; A45B 2011/005; A45B 15/00; A45B 19/00; A45B 2019/001; A45B 2019/007; A45B 19/10; A45B 2023/0006; A45B 23/00; A45B 2023/0093

See application file for complete search history.

(56) References Cited

U.S. PATENT DOCUMENTS

| | | | | | |
|---|---|---|---|---|---|
| 2,828,758 | A * | 4/1958 | Moro | A45B 23/00 | 135/155 |
| 2,888,021 | A * | 5/1959 | Adams | A45B 23/00 | 135/114 |
| 4,312,371 | A * | 1/1982 | Koon | A45B 11/00 | 135/19.5 |
| 4,347,862 | A * | 9/1982 | Secon | A45B 17/00 | 135/15.1 |
| 5,085,239 | A * | 2/1992 | Chin-Hung | A45B 25/18 | 135/25.33 |
| 5,355,902 | A * | 10/1994 | Schlangen | A45B 11/00 | 135/20.1 |

(Continued)

FOREIGN PATENT DOCUMENTS

| | | | | |
|---|---|---|---|---|
| WO | WO-2017042771 A2 * | 3/2017 | | A45B 19/10 |
| WO | WO-2017089713 A1 * | 6/2017 | | A45B 11/00 |

*Primary Examiner* — David R Dunn
*Assistant Examiner* — Danielle Jackson

(57) ABSTRACT

An asymmetrical umbrella includes a structure formed by a single frame member that is attached at its first and second ends to a handle and also attached to the handle at a third position along the frame member between the ends of the frame member such that the frame member passes through the handle at the third position. A sleeve collects two portions of the frame member together at a position opposite a periphery of the umbrella from the handle. A canopy is attached to the frame member. The umbrella is collapsible into a generally planar shape that is easily transportable.

18 Claims, 10 Drawing Sheets

(56) References Cited

U.S. PATENT DOCUMENTS

| | | | | |
|---|---|---|---|---|
| 2007/0012344 | A1* | 1/2007 | Watts | A45B 11/00 135/20.1 |
| 2007/0283991 | A1* | 12/2007 | Sherts | A45B 23/00 135/90 |
| 2011/0099692 | A1* | 5/2011 | Essex | A42B 1/18 2/184.5 |
| 2013/0284220 | A1* | 10/2013 | Liu | A45B 11/00 135/20.1 |

* cited by examiner

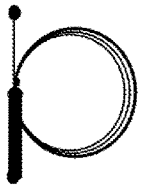
FIG. 9a
FIG. 9b
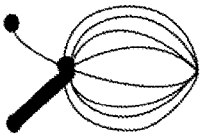
FIG. 9c
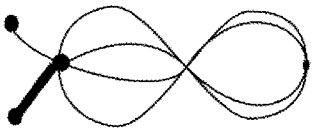
FIG. 9d
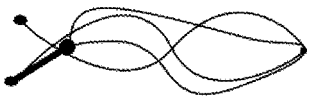
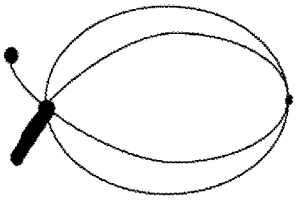
FIG. 9e
FIG. 9f
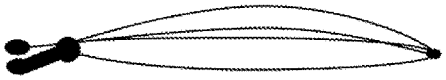
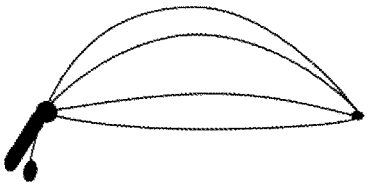
FIG. 9g
FIG. 9h
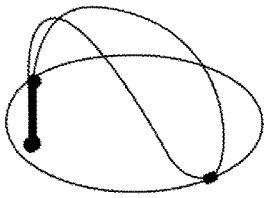

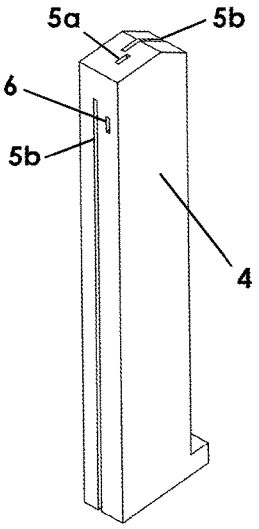
FIG. 11a
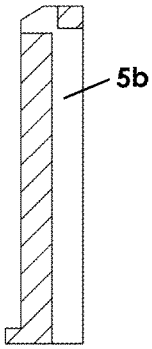
FIG. 11g
SECTION A-A
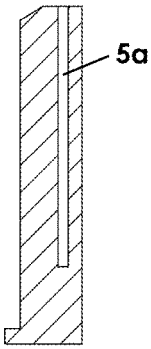
FIG. 11h
SECTION B-B
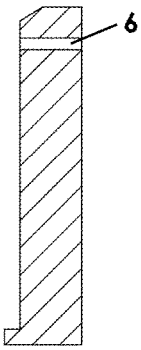
FIG. 11i
SECTION C-C
FIG. 11f
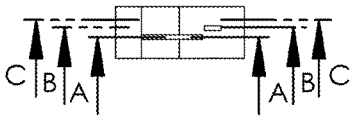
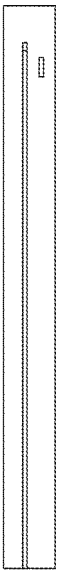
FIG. 11b
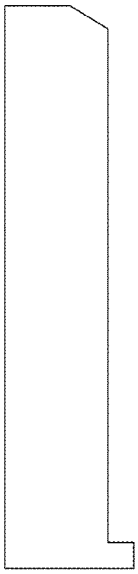
FIG. 11c
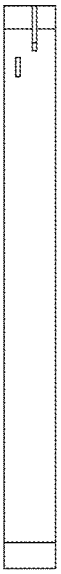
FIG. 11d
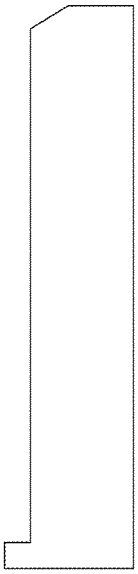
FIG. 11e

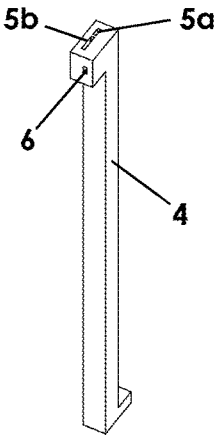
FIG. 12a
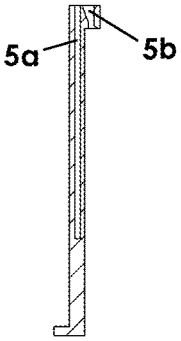
FIG. 12g
SECTION A-A
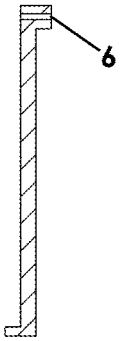
FIG. 12h
SECTION B-B
FIG. 12f
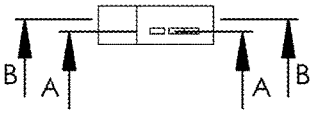
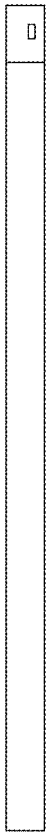
FIG. 12b
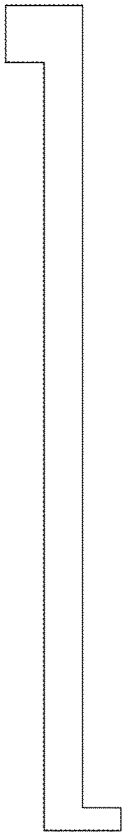
FIG. 12c
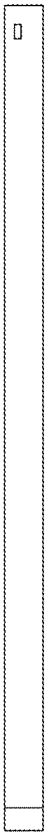
FIG. 12d
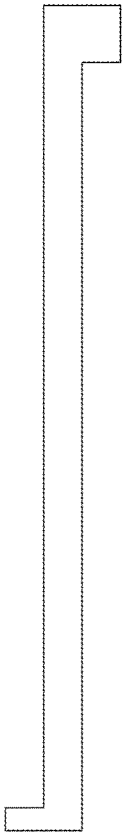
FIG. 12e

ASYMMETRICAL UMBRELLA

CROSS-REFERENCE TO RELATED APPLICATION

This application claims the benefit of U.S. Provisional Application No. 62/125,994, filed Feb. 5, 2015.

TECHNICAL FIELD

This invention relates to umbrellas for use in shielding a user from rain, snow, sun, wind, etc.

DESCRIPTION OF RELATED ART

Traditional umbrellas have a canopy that is supported at its center by a straight handle. Typically, the perimeter of an umbrella canopy is circular, although square or octagonal shapes have also been used. However, in nearly every instance, the central handle attaches to the canopy at a point that is generally located near the centroid of the canopy shape.

The central location of the handle presents several problems. For example, a single user of an umbrella is only able to take advantage of half of the canopy's shelter if they hold the handle at its most comfortable position to the side of their head. Accordingly, a user must select an umbrella having a canopy with a radius (not diameter) approximately equal to the user's shoulder-to-shoulder width in order to provide themselves full shelter. This leads to more than half of the umbrella's shelter going unused. Not only must the user carry the weight of an umbrella that is less than half used, the umbrella also takes up more than twice the space needed to accomplish its purpose and is more unruly to hold in windy conditions due to the unused, but necessary extra surface area of the canopy. In crowded spaces such as city sidewalks, these disadvantages are even more pronounced and evident.

In addition, traditional umbrellas are nearly all collapsed into a long, cylindrical shape when not in use. Such a shape does not lend itself to storage in many bags or briefcases that people often carry. Although some compact umbrellas exist which can be collapsed into smaller cylindrical shapes, such shapes may still present storage problems in certain situations and in certain bags.

Also, the canopy fabric or material of traditional umbrellas is permanently attached. Accordingly, if the fabric gets worn, or if the user desires a different color or pattern for their umbrella, they must purchase an entire new umbrella even if the structure of the umbrella is still functional.

Accordingly, the need exists for an umbrella that makes the most efficient use of the space under its canopy to only be as large as is needed to shelter its user, rather than to accommodate its handle placement. There is also a need for an umbrella that has a more convenient collapsed shape. There is also a need for an umbrella that permits a user to change the canopy material while retaining and reusing the umbrella's structural components.

SUMMARY

This disclosure provides asymmetrical umbrellas.

In an aspect, an asymmetrical umbrella comprises a handle, a single frame member attached at its first and second ends to the handle and also attached to the handle at a third position along the frame member between the ends of the frame member such that the frame member passes through the handle at the third position, a sleeve collecting two portions of the frame member together at a position opposite a periphery of the umbrella from the handle, and a canopy attached to the frame member.

In another aspect, the attachment of the frame member to the handle at the third position permits the frame member to rotate relative to the handle.

In another aspect, the frame member has a rectangular profile.

In another aspect, the first end of the frame member is attached to the handle and terminates at the handle and the second end of the frame member attaches to the handle and extends beyond the handle.

In another aspect, the canopy is removably attached to the frame member.

In another aspect, the canopy is attached to the frame member via snap fasteners.

In another aspect, the canopy includes a closure between the ends of the frame member between the handle and the sleeve which, when closed, draws the ends of the frame member together to hold the umbrella in an open position.

In another aspect, the closure is a zipper.

In another aspect, the asymmetrical umbrella also comprises a frame collar encircling the frame member ends between the handle and the sleeve such that moving the frame collar from the handle or the sleeve towards an apex of the umbrella draws the ends of the frame member together to hold the umbrella in an open position.

In another aspect, an asymmetrical umbrella comprises a handle, a single frame member (a) fixedly attached at its first end to the handle, (b) movably attached at its second end to the handle such that the second end of the frame member extends beyond the handle and also (c) attached to the handle at a third position along the frame member between the ends of the frame member such that the frame member passes through the handle at the third position, a sleeve collecting two portions of the frame member together at a position opposite a periphery of the umbrella from the handle, a canopy attached to the frame member, and a securing feature attached to one of the handle or the second end of the frame member configured to selectively engage the other of the handle or the second end of the frame member so as to selectively hold the handle and the second end of the frame member together, thereby selectively holding the asymmetrical umbrella in an open position.

In another aspect, the securing feature is a loop.

BRIEF DESCRIPTION OF THE DRAWINGS

FIGS. 9*a*-9*h* show a top perspective view of an asymmetrical umbrella structure in transition between a closed position (shown in FIG. 9*a*) and an open position (shown in FIG. 9*h*) according to an embodiment of the present application.

FIGS. 11*a*-11*f* show a top perspective view, left side view, front view, right side view, back view and top view, respectively, of a handle according to an embodiment of the present application.

FIGS. 11*g*-11*i* are cross section views of the handle shown in FIGS. 11*a*-11*f* taken through planes A-A, B-B and C-C, respectively, as indicated in FIG. 11*f*.

FIGS. 12*a*-12*f* show a top perspective view, left side view, front view, right side view, back view and top view, respectively, of a handle according to an embodiment of the present application.

FIGS. 12*g* and 12*h* are cross section views of the handle shown in FIGS. 12*a*-12*f* through planes A-A and B-B, respectively, as indicated in FIG. 12*f*.

DETAILED DESCRIPTION

Embodiments of asymmetrical umbrellas are described herein. While aspects of the described asymmetrical umbrellas can be implemented in any number of different configurations, the embodiments are described in the context of the following exemplary configurations. The descriptions and details of well-known components and structures are omitted for simplicity of the description.

The description and figures merely illustrate exemplary embodiments of asymmetrical umbrellas. It will thus be appreciated that those skilled in the art will be able to devise various arrangements that, although not explicitly described or shown herein, embody the principles of the present subject matter. Furthermore, all examples recited herein are intended to be for illustrative purposes only to aid the reader in understanding the principles of the present subject matter and the concepts contributed by the inventor(s) to furthering the art, and are to be construed as being without limitation to such specifically recited examples and conditions. Moreover, all statements herein reciting principles, aspects, and embodiments of the present subject matter, as well as specific examples thereof, are intended to encompass equivalents thereof.

Figure 1:
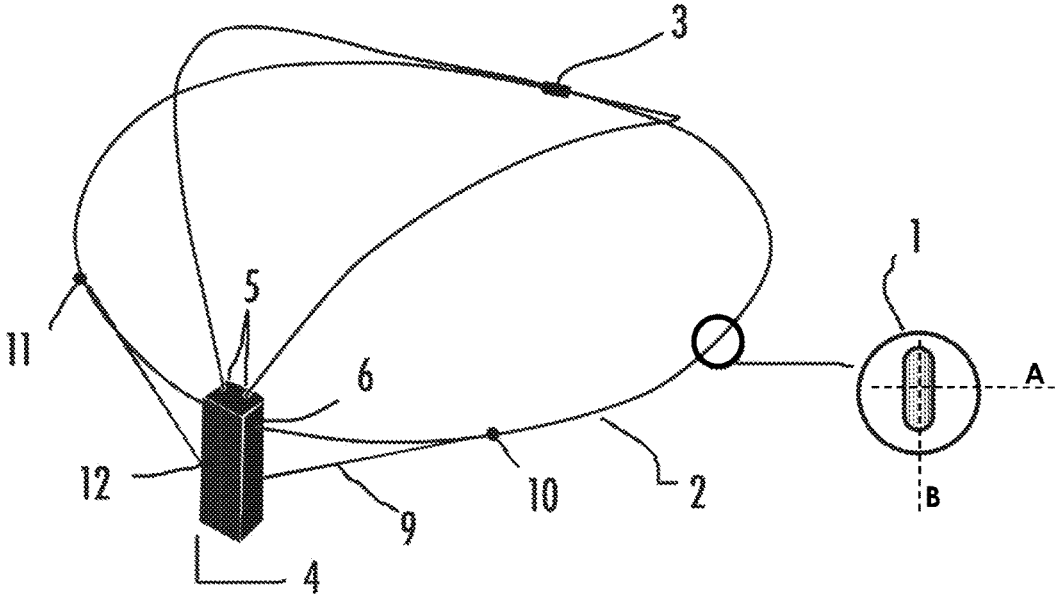
FIG. 1 is a top perspective view of an asymmetrical umbrella structure in an open position according to an embodiment of the present application.
Figure 2:
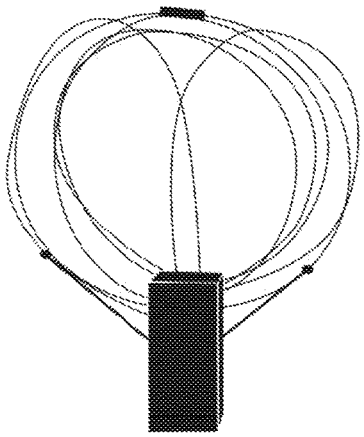
FIG. 2 is a front view of an asymmetrical umbrella structure in a closed position according to an embodiment of the present application.
Figure 3:
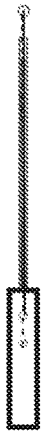
FIG. 3 is a side view of an asymmetrical umbrella structure in a closed position according to an embodiment of the present application.

Turning now to FIG. 1, an embodiment of an asymmetric umbrella is composed of a frame member 2 joined to a handle 4 which, when inverted, creates its convex shape. As is evident from FIG. 1, the asymmetrical umbrella according to the present disclosure includes much fewer components and moving parts than a traditional umbrella. Accordingly, compared to traditional umbrellas, the present asymmetrical umbrella may be manufactured with a much lower component and labor cost than a traditional umbrella. Also, because the asymmetrical umbrella described herein contains very few moving parts, the reliability and robustness of the asymmetrical umbrella is also much improved from traditional umbrellas.

A material for the frame member 2 may be selected from among a range of materials (or any combination thereof) that have a relative high stiffness and shape retention, for example, high strength plastic, carbon fiber, spring steel, etc. In one particular example, the frame member 2 is composed of spring steel which has been heat treated to improve its shape retention properties. The frame member 2 may also be coated or plated to improve its mechanical, anti-corrosive, anti-oxidation, or other properties.

The frame member's cross sectional profile can be an important factor in determining how it bends and moves as a user collapses or expands the umbrella. In one example, shown by the cross section detail view 1 of frame member 2 in FIG. 1, the frame member 2 has a generally rectangular cross section with its longer dimension oriented vertically relative to the ground at the point along the frame member 2 at which detail view 1 is taken. As shown in FIG. 1, the cross section of frame member 2 need not be strictly rectangular, as the profile shown in FIG. 1 shows a shape with rounded top and bottom profiles with relatively straight left and right profiles. As used in the present disclosure, the term "rectangular profile" shall be considered broadly to include a profile with a larger section modulus relative to a neutral axis in one direction than a section modulus in relative to a neutral axis in a perpendicular direction. Using the example shown in detail 1 of FIG. 1, the profile shown has a larger section modulus relative to neutral axis A than it does relative to neutral axis B.

In the particular example shown in FIG. 1, the umbrella's frame member 2 is composed of a single piece of spring steel wire, with a rectangular profile (as shown in detail 1). Forming the frame member 2 of a single piece of material, the material itself (spring steel), and profile choice independently and collectively may enable the umbrella to have increased resistance to deflection in horizontal and vertical directions. The two ends of the frame member 2 are attached to a top of the handle 4. In the example shown in FIG. 1, the ends of the frame member 2 are secured in holes 5 of the handle. In one embodiment, the attachment of the ends of the frame member 2 to the handle 4 is accomplished in a rigid manner such that the ends of the frame member 2 are not able to bend or flex relative to the handle 4 at the connection between the handle 4 and the ends of the frame member 2. As shown in FIG. 1, one way to accomplish such a rigid connection is to embed a length of the ends of frame member 2 in holes or bores 5 in the handle 4. In another embodiment, both ends of the frame member 2 are inserted together into a single hole 5 in the handle 4 and fixed in the single hole 5.

The frame member 2 in its open position (as shown in FIG. 1) generally forms two loops. Tracing the frame member 2 from its ends at holes 5 in handle 4, the ends of the frame member cross one another within sleeve 3 and then loop back around to the handle 4 in a second loop. The second loop is fed through a through hole 6 in handle 4. In one embodiment, the frame member is permitted to rotate within hole 6. For example, in an embodiment in which the frame member has a rectangular profile as shown in detail 1 of FIG. 1, the frame member is permitted to rotate within hole 6 from a configuration in which its long, straight sides are generally parallel to the long direction of handle 4 to a configuration in which the long, straight sides on the frame member profile are perpendicular to the long dimension of the handle 4. The frame member 2 may also be permitted to slide longitudinally through hole 6.

Figure 7A:
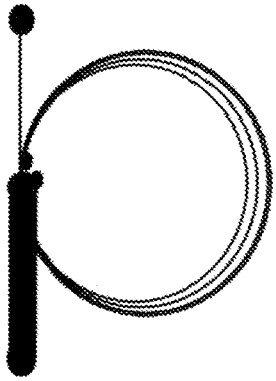
FIGS. 7*a*-7*e* show a top perspective view of an asymmetrical umbrella structure in transition between a closed position (shown in FIG. 7*a*) and an open position (shown in FIG. 7*e*) according to an embodiment of the present application.
Figure 7B:
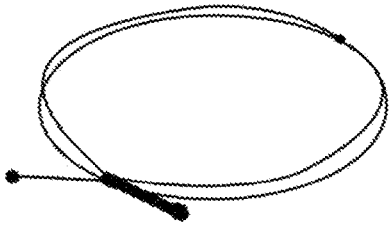
Figure 7C:
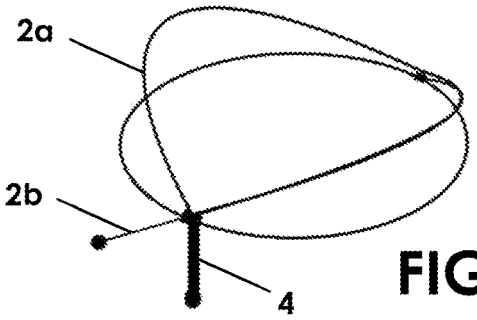
Figure 7D:
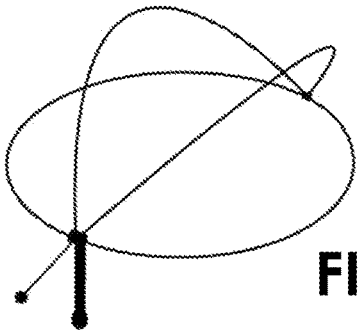
Figure 7E:
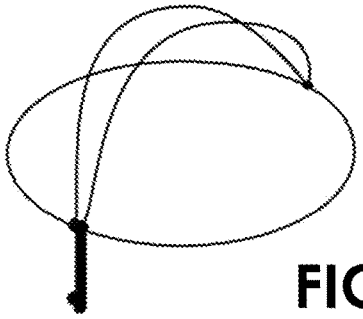
Figure 8A:
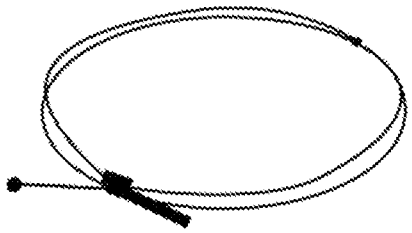
FIGS. 8*a*-8*d* show a top perspective view of an asymmetrical umbrella structure in transition between a closed position (shown in FIG. 8*a*) and an open position (shown in FIG. 8*d*) according to an embodiment of the present application.
Figure 8B:
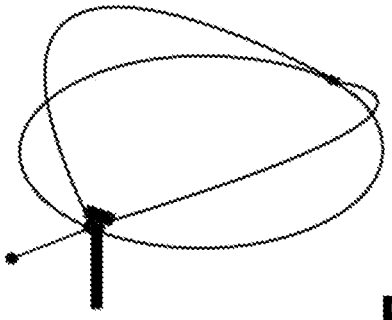
Figure 8C:
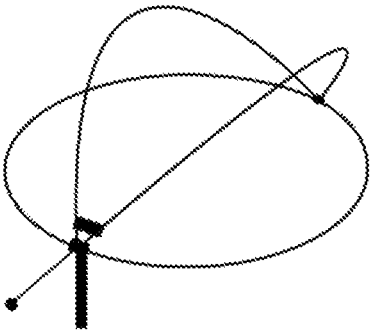
Figure 8D:
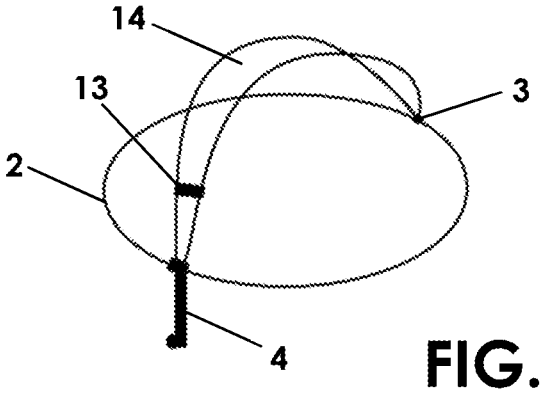

In another embodiment, shown in FIGS. 7*a*-7*e*, one end 2*a* of the frame member 2 is fixedly connected to and terminates at the handle 4. The other end 2*b* of the frame member connects to the handle 4 but continues through it. The connection between the ends 2*a*, 2*b* of the frame member and the handle 4 may be semi-rigid, but still somewhat flexible. As one example, the ends 2*a*, 2*b* of the frame member may be embedded in a rubber block at the end of the handle 4. Indeed, the entire handle 4 may be comprised of rubber. As shown in FIGS. 7*a* and 7*b*, when the umbrella is in a closed position, the end 2*b* of the frame member and the handle 4 extend in generally opposite directions. In the open position, shown in FIG. 7*e*, the end 2*b* of the frame member and the handle are generally parallel. In one embodiment, the end 2*b* of the frame member and the handle 4 may be held together in order to hold the umbrella in the open position. FIGS. 7*a*-7*e* show a transition between a closed position (shown in FIG. 7*a*) and an open position (shown in FIG. 7*e*) of an exemplary asymmetric umbrella. FIGS. 8*a*-8*d* also show a transition between a closed position (shown in FIG. 8*a*) and an open position (shown in FIG. 8*d*) of another exemplary asymmetric umbrella. FIGS. 9*a*-9*h* also show a transition between a closed position (shown in FIG. 9*a*) and an open position (shown in FIG. 9*h*) of yet another exemplary asymmetric umbrella. FIGS. 10*a*-10*e* also show a transition between a closed position (shown in FIG. 10*a*) and an open position (shown in FIG. 10*e*) of still another exemplary asymmetric umbrella.

Figure 13:
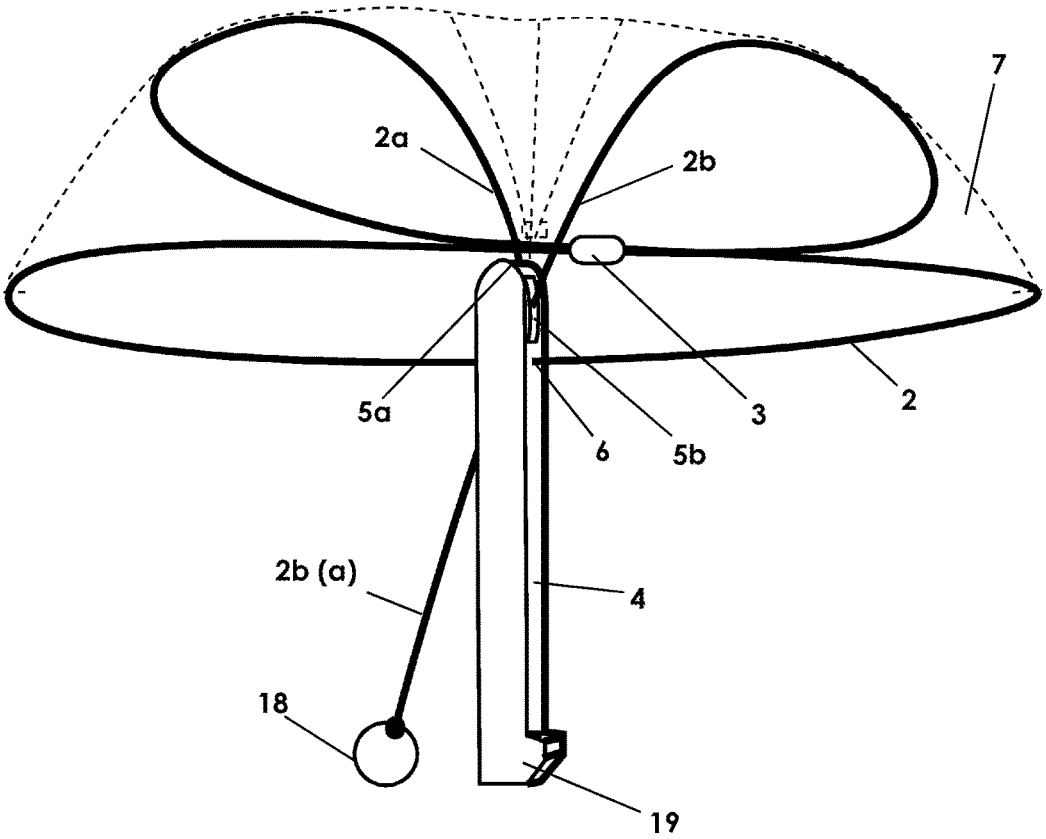
FIG. 13 is a side perspective view of an asymmetrical umbrella in a near-open position according to an embodiment of the present application.
Figure 14:
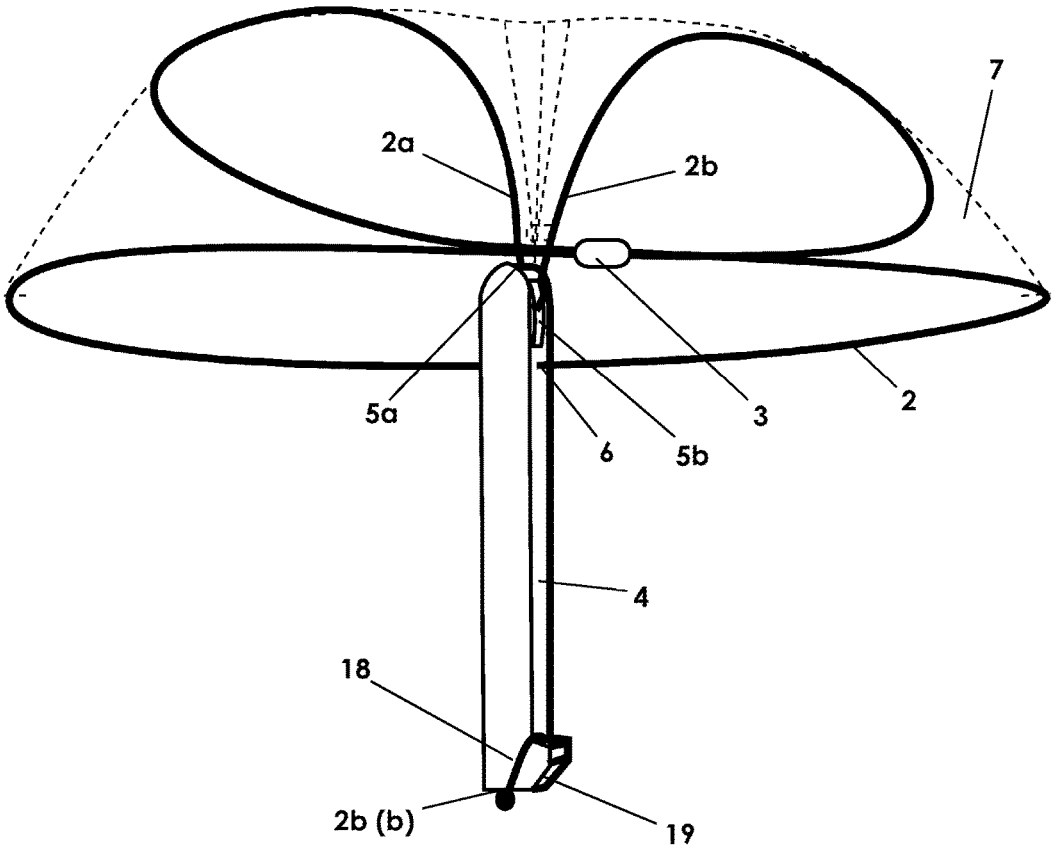
FIG. 14 is a side perspective view of an asymmetrical umbrella in an open position according to an embodiment of the present application.

In another embodiment, shown in FIGS. 13 and 14, like the embodiment shown in FIGS. 7*a*-7*e*, 8*a*-8*d*, 9*a*-9*h* and 10*a*-10*e*, one end 2*a* of the frame member 2 may be fixedly connected to and terminate at the handle 4 at hole 5*a*. However, the other end 2*b* of the frame member may (fixedly or movably) connect to the handle 4 at hole 5*b* and continue through the handle within hole 5*b*. Between the ends 2*a* and 2*b* of the frame member 2, the frame member 2 also passes through through hole 6 in the handle 4. For example, as shown in FIGS. 11*a*-11*i*, a handle 4 includes holes 5*a*, 5*b* and 6. The holes are shown in cross section in FIGS. 11*g*-11*i*, which are cross section views of the handle 4 of FIGS. 11*a*-11*f* taken through planes A-A, B-B and C-C, respectively, as indicated in FIG. 11*f*. As shown in FIGS. 11*a*, 11*b* and 11*g*, hole 5*b* may take the shape of a slot open to one side of the handle. In another exemplary handle embodiment, shown in FIGS. 12*a*-12*h*, holes 5*a*, 5*b* and 5*c* may also be present in a handle (shown in cross section in FIGS. 12*g* and 12*h*, which are cross section views of the handle 4 of FIGS. 12*a*-12*f* taken through planes A-A and B-B, respectively, as indicated in FIG. 12*f*), however, hole 5*b* may simply be a through hole in handle 4 without forming a slot. In the handle embodiments shown in FIGS. 11*a*-11*i* and 12*a*-12*h*, the end 2*a* of the frame member 2 inserted in hole 5*a* may be permanently affixed thereto, while the end 2*b* of the frame member 2 protruding through hole 5*b* may be permitted to slide longitudinally therethrough and pivot about an axis perpendicular to plane A-A, in a manner similar to the movement of the frame member end 2*b* between FIGS. 13 (position 2*b*(*a*)) and FIG. 14 (position 2*b*(*b*)). Frame member end 2*b* may also be permitted to rotate about its longitudinal axis.

FIGS. 13 and 14 show an exemplary asymmetrical umbrella in a near-open and open position, respectively. The movement of the movable frame member end 2*b* between the position 2*b*(*a*) shown in FIG. 13 and the position 2*b*(*b*) shown in FIG. 14 is a driving factor in the umbrella's shape being fully open. In order to secure the frame member end 2*b* (and thus the umbrella structure) in an open position, the frame member end may be provided with a securing feature, such as a loop 18, which is configured to secure the frame member end 2*b* to the handle 4. In the example shown in FIGS. 13 and 14, the loop 18 attached to the frame member end 2*b* may be secured over a feature such as a hook on handle 4. Of course, such a securing feature (e.g. a loop 18) may alternatively be fixed to the handle and may be configured to be secured to or over a the frame member end 2*b* or a feature on frame member end 2*b* to hold the asymmetrical umbrella in an open position.

In one embodiment, shown in FIG. 1, an inversion preventer 9 may be attached to the second loop of the frame member 2 at points 10, 11 near the handle 4 but spaced apart from the handle 4 by some non-zero distance. In one embodiment, the inversion preventer 9 may be fed through a through hole 12 in the handle 4. In one embodiment, the inversion preventer 9 may be comprised of an elastic shock cord material. The inversion preventer 9 may help in situations such as high-wind environments to provide additional structural integrity to the umbrella and to prevent the canopy from inverting or flipping backwards with respect to the handle 4.

In another embodiment, shown generally in FIGS. 8*a*-8*d*, the umbrella may include a frame collar 13 which help to hold the frame member in an open position. FIGS. 8*a*-8*d* show a transition between a closed position (shown in FIG. 8*a*) and an open position (shown in FIG. 8*d*) of an exemplary asymmetric umbrella. The frame collar 13 ties together two portions of the frame member. In FIGS. 8*a*-8*d*, the frame collar is shown tying together the ends of the frame member 2 near the handle, although a frame collar 13 would also function well tying together the ends of the frame member nearer to the sleeve 3, but still between the sleeve 3 and the handle 4 on the frame member ends. In the open position, shown in FIG. 8*d*, the frame collar 13 is slid towards an apex 14 of the frame member ends. In that position, the frame collar keeps the frame member ends together in order to hold the umbrella in the open position.

The ends of the spring wire are seated in the handle that must be pivoted about to open and close the canopy. Flipping the handle into the plane of the circular loop is what activates the umbrella's shape. To collapse it into storage (closed) mode, the user holds the frame member near the sleeve 3 and the handle 4 and twists them, similarly to how one collapses a band saw blade. FIGS. 2, 3, 5, 6 and 7*a* show examples of asymmetrical umbrella structures in a closed or storage position or mode.

Figure 4:
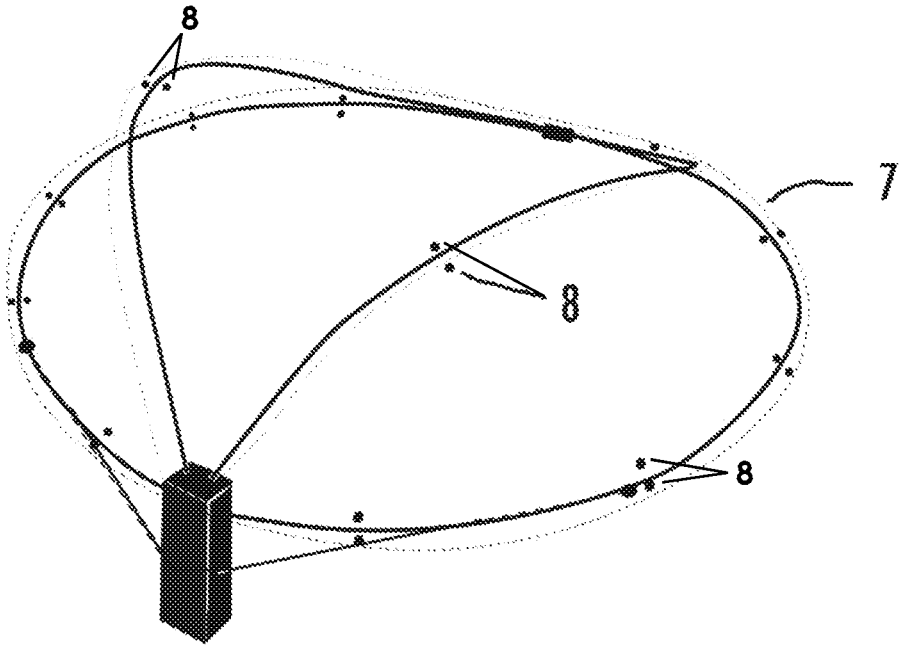
FIG. 4 is a top perspective view of an asymmetrical umbrella structure with canopy in an open position according to an embodiment of the present application.
Figure 5:
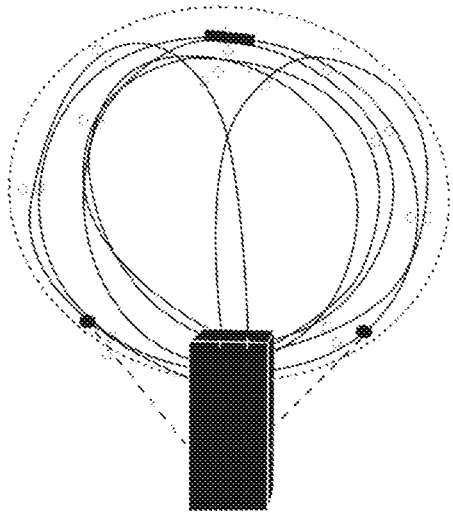
FIG. 5 is a front view of an asymmetrical umbrella structure with canopy in a closed position according to an embodiment of the present application.
Figure 6:
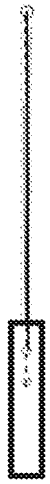
FIG. 6 is a side view of an asymmetrical umbrella structure with canopy in a closed position according to an embodiment of the present application.

The canopy 7 may be made of very lightweight material. In one embodiment, shown in FIG. 4, the canopy 7 includes snap fasteners 8 that may fasten the canopy material around the frame member 2. (It should be noted that in FIG. 4, only three pairs of snap fastener components are identified by the reference number 8 for clarity, although the figure contains many more snap fasteners.) As shown in FIG. 4, the snap fastener components are shown unfastened, but once fastened, they come together as shown in FIGS. 10*a*-10*e*, and in particular in detail views 15 and 16 of FIG. 10*e*. In high wind conditions, snap fasteners 8 may be configured to break away, saving the umbrella and canopy from permanent damage. This break-away feature, combined with the flexible nature of the frame member, makes the asymmetrical umbrella of the present disclosure much more robust and less prone to failure than a traditional umbrella.

Figure 10A:
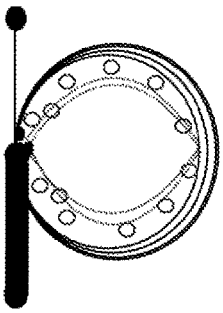
FIGS. 10*a*-10*e* show a top perspective view of an asymmetrical umbrella structure with canopy in transition between a closed position (shown in FIG. 10*a*) and an open position (shown in FIG. 10*e*) according to an embodiment of the present application.
Figure 10B:
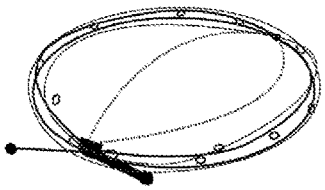
Figure 10C:
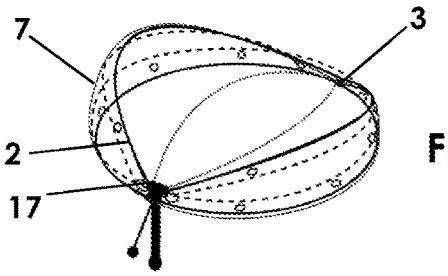
Figure 10D:
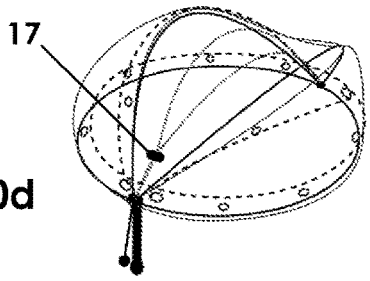
Figure 10E:
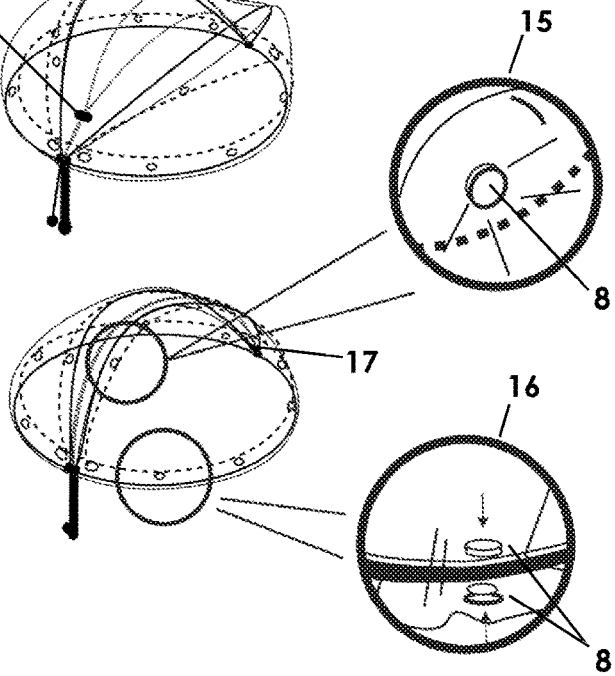

In another embodiment, shown in FIGS. 10*a*-10*e*, a canopy 7 is attached to the frame member 2 via snap fasteners 8. In FIGS. 10*a*-10*e*, dashed lines depict edges of the canopy material or fabric that may be hidden in the view orientations shown by the figures. In the embodiment shown in FIGS. 10*a*-10*e*, a closure 17 is provided in the canopy 7 between the ends of the frame member 2. In one example, the closure 17 may be a zipper. The closure 17 functions similarly to a frame collar 13 such as the one shown in FIGS. 8*a*-8*d*. When the canopy 7 and the frame member 2 are moved into their open positions, the closure 17 draws the canopy material together between the frame member ends in order to bring the frame member ends together, and in so doing to holds the umbrella in the open position. In the example of a zipper closure 17, the zipper may be closed by sliding a zipper traveller from the handle end of the canopy to the sleeve 3 end of the canopy, as shown in FIGS. 10*c*-10*e*, or from the sleeve 3 end of the canopy 7 towards the handle 4.

In an embodiment in which the canopy 7 is secured to the frame member 2 by snap fasteners 8, it will be appreciated that the canopy 7 will be easily removable from the frame member. Accordingly, changing the canopy from one piece of canopy material to another for decorative reasons or for technical reasons is user-friendly, quick and simple.

While the present disclosure has been described with reference to one or more particular embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this disclosure. In addition, elements and/or features of different illustrative and exemplary embodiments herein may be combined with each other and/or substituted for each other within the scope of this disclosure.

What is claimed is:

1. An asymmetrical umbrella comprising:

a handle;

a single frame member attached at its first and second ends to the handle and also attached to the handle at a third position along the frame member between the ends of the frame member such that the frame member passes through the handle at the third position;

a sleeve collecting two portions of the frame member together at a position opposite a periphery of the umbrella from the handle; and a canopy attached to the frame member, wherein the first end of the frame member is attached to the handle and terminates at the handle and the second end of the frame member attaches to the handle and extends beyond the handle.

2. The asymmetrical umbrella of claim 1, wherein the attachment of the frame member to the handle at the third position permits the frame member to rotate relative to the handle.

3. The asymmetrical umbrella of claim 1, wherein the frame member has a rectangular profile.

4. The asymmetrical umbrella of claim 1, wherein the first end of the frame member is fixedly attached to the handle and the asymmetrical umbrella further includes a securing feature configured to selectively secure the second frame end to the handle to hold the asymmetrical umbrella in an open position.

5. The asymmetrical umbrella of claim 1, wherein the canopy is removably attached to the frame member.

6. The asymmetrical umbrella of claim 1, wherein the canopy is attached to the frame member via snap fasteners.

7. The asymmetrical umbrella of claim 1, further comprising a frame collar encircling the frame member ends between the handle and the sleeve such that moving the frame collar from the handle or the sleeve towards an apex of the umbrella draws the ends of the frame member together to hold the umbrella in an open position.

8. An asymmetrical umbrella comprising:

a handle;

a single frame member attached at its first and second ends to the handle and also attached to the handle at a third position along the frame member between the ends of the frame member such that the frame member passes through the handle at the third position;

a sleeve collecting two portions of the frame member together at a position opposite a periphery of the umbrella from the handle; and a canopy attached to the frame member, wherein the canopy includes a closure between the ends of the frame member between the handle and the sleeve which, when closed, draws the ends of the frame member together to hold the umbrella in an open position.

9. The asymmetrical umbrella of claim 8, wherein the closure is a zipper.

10. The asymmetrical umbrella of claim 8, wherein the attachment of the frame member to the handle at the third position permits the frame member to rotate relative to the handle.

11. The asymmetrical umbrella of claim 8, wherein the frame member has a rectangular profile.

12. The asymmetrical umbrella of claim 8 wherein the first end of the frame member is attached to the handle and terminates at the handle and the second end of the frame member attaches to the handle and extends beyond the handle.

13. The asymmetrical umbrella of claim 12, wherein the first end of the frame member is fixedly attached to the handle and the asymmetrical umbrella further includes a securing feature configured to selectively secure the second frame end to the handle to hold the asymmetrical umbrella in an open position.

14. The asymmetrical umbrella of claim 8, wherein the canopy is removably attached to the frame member.

15. The asymmetrical umbrella of claim 8, wherein the canopy is attached to the frame member via snap fasteners.

16. The asymmetrical umbrella of claim 8, further comprising a frame collar encircling the frame member ends between the handle and the sleeve such that moving the frame collar from the handle or the sleeve towards an apex of the umbrella draws the ends of the frame member together to hold the umbrella in an open position.

17. An asymmetrical umbrella comprising:

a handle;

a single frame member (a) fixedly attached at its first end to the handle, (b) movably attached at its second end to the handle such that the second end of the frame member extends beyond the handle and also (c) attached to the handle at a third position along the frame member between the ends of the frame member such that the frame member passes through the handle at the third position;

a sleeve collecting two portions of the frame member together at a position opposite a periphery of the umbrella from the handle;

a canopy attached to the frame member; and a securing feature attached to one of the handle or the second end of the frame member configured to selectively engage the other of the handle or the second end of the frame member so as to selectively hold the handle and the second end of the frame member together, thereby selectively holding the asymmetrical umbrella in an open position.

18. The asymmetrical umbrella of claim 17, wherein the securing feature is a loop.

* * * * *